US006901934B1

(12) United States Patent
Tran

(10) Patent No.: US 6,901,934 B1
(45) Date of Patent: Jun. 7, 2005

(54) SYSTEM AND METHODS FOR DESIGNING AND DISPLAYING ARTIFICIAL NAILS

(76) Inventor: David Ngu Tran, 29 E. Main St., Bay Shore, NY (US) 11706

( * ) Notice: Subject to any disclaimer, the term of this patent is extended or adjusted under 35 U.S.C. 154(b) by 513 days.

(21) Appl. No.: 10/109,778

(22) Filed: Mar. 30, 2002

(51) Int. Cl.[7] ..... A45D 29/00; A45D 29/18
(52) U.S. Cl. ..... 132/73; 132/73.5
(58) Field of Search ..... 132/73, 73.5; D28/56, D28/57, 61; 211/163, 170

(56) References Cited

U.S. PATENT DOCUMENTS 2,300,170 A * 10/1942 Pickard ..... 434/100
3,485,344 A * 12/1969 Aylott ..... 206/784
3,578,158 A * 5/1971 Aylott ..... 206/509
D309,196 S * 7/1990 LaJoie ..... D28/56
5,570,793 A * 11/1996 Killough ..... 211/70
5,904,149 A * 5/1999 Ruhl et al. ..... 132/73
5,988,178 A * 11/1999 Bair ..... 132/73

* cited by examiner

*Primary Examiner*—Robyn Kieu Doan
(74) *Attorney, Agent, or Firm*—Michael I Kroll

(57) ABSTRACT

A system and related methods provide the artisan and his customer with artificial nails that can be magnetically coupled to a special nail holding tool, aesthetic design elements, such as geometric shapes, nail borders, exotic shapes, and the like, and a special display having defined spaces, each of which couples with a completed nail. The spaces are visually separated and given unique identification numbers. The display can be housed in an enclosure that can be hung from walls, or inclined upon horizontal surfaces. The magnetic coupling allows the nail being designed to be securely held on the holding tool, even while the tool is elevated, rotated, and turned for various desirable views. The full nail is visible because the magnetic coupling eliminates the need for typical recessed mounts or grasping devices. Full visibility is also achieved on the magnetic display.

47 Claims, 13 Drawing Sheets

SYSTEM AND METHODS FOR DESIGNING AND DISPLAYING ARTIFICIAL NAILS

BACKGROUND OF THE INVENTION

1. Field of the Invention

The present invention relates generally to a system and related methods for creating and displaying designer artificial nails of the type that are attached to the user's natural nails.

2. Description of the Prior Art

There are other methods for creating designer artificial nails and/or displaying designer nails but while these design and display devices may be suitable for the purposes for which they were designed, they would not be as suitable for the purposes of the present invention, as hereinafter described. For example, no prior art systems and methods provide magnetic coupling between the nails and the mounting devices used during design, nor do prior art systems and methods provide magnetic coupling between completed nails and an enclosed display surface, nor do prior art systems and methods provide magnetic coupling between design elements and the nails during the design process such that various designs can be rapidly considered before painting or otherwise permanently apply the design to the nail.

SUMMARY OF THE PRESENT INVENTION

A system and related methods are provided for creating and displaying designer artificial nails utilizing magnetic forces as the retaining and holding means for the nails and design elements during the design and display process.

The present invention is comprised of a plurality of artificial nails, a nail holding tool, design elements, and a case enclosing a display. The artificial nails are made from a material having magnetic properties. While the holding member and display case are made from a material having complementary magnetic properties, such as metal components. During the design process, the nails are magnetically coupled with the nail holding tool, and the design elements are magnetically coupled with the nail. During the display process the nails are magnetically coupled with the display, and in some embodiments the design elements are magnetically coupled with the nail.

The system contemplates a magnetized nail in conjunction with a nail holding tool, a display, and design elements that are attracted by magnets, as well as, a magnetic holding tool, a magnetic display, and magnetic design elements in conjunction with a artificial nail that is attracted to magnets.

The nails are made of a thin pieces of metal that have inherent proprieties that allow them to couple magnetically. The nail holding tool is comprised of an elongated member having at least part of its top surface dedicated for magnetic coupling. A substrate of similar dimension provides backing and strength to the tool. The construction of the nail holding tool is formed in a way that the user may manipulate the tool in various ways to aid in the design process.

After the nail design is completed, the finished nail may be displayed on a magnetic display having a thin sheet of magnetic material with a plurality of defined spaces on its planar surface to provide each nail with a mounting area and identification means.

A housing is also provided for the display to be placed in, with a transparent cover that can be impregnated with special properties such as ultraviolet ray protection whereby the display can be positioned in store windows and the artistic creations and colorings will be protected from ultraviolet rays.

The transparent cover slides over the housing to provide a viewable medium and protection against stress or harm to the nails. On the backside of the housing a wall attachment member with a plurality of wall spacers is provided so that the housing may lay flush against a wall when mounted. In addition a fold out back support is provided to hold the housing in a steady upright position when placed on an upright surface.

A primary object of the present invention is to provide a means for holding a nail while in the designing phase using magnetic coupling of the nail.

Another object of the present invention is to provide a means of holding and displaying a finished nail in an aesthetically pleasing manner.

Still another object of the present invention is to provide design elements for magnetic coupling with the nail during the design and/or display process.

Yet another object of the present invention is to provide a housing to place finished nails that protects the nails from various elements while providing a viewable display through usage of a transparent cover.

Still yet another object of the present invention is to provide means of mounting the display on an upright structure.

Yet another object of the present invention is to provide means of allowing the housing to be free standing on a horizontal surface.

Additional objects of the present invention will appear as the description proceeds.

A system for designing artificial nails for attachment to a user's natural nails is provided, comprising: at least one artificial nail; and an elongated nail holding tool, the nail holding tool having a work surface, the work surface being magnetically coupled to the nail, such that the coupled nail is held steady on the work surface, and further such that the work surface can be moved into a desired position by hand-manipulating the holding tool.

In one embodiment, the nail is magnetized.

In one embodiment, the nail holding tool top surface is magnetized.

In one embodiment, the nail holding tool has a non-metallic bottom surface.

In one embodiment, the nail holding tool has a non-slip bottom surface.

In one embodiment, the nail holding tool has a substantially flat bottom surface.

In one embodiment, the nail holding tool has a wooden bottom surface.

In one embodiment, the nail holding tool has a handle.

In one embodiment, the nail is made of at least two materials, and one of the materials cannot be magnetically coupled.

In one embodiment, the nail further comprises a curved bottom surface, and the nail holding tool work surface is at least partially curved for mating with the nail curved bottom surface.

In one embodiment, the at least one nail has a bottom surface, the bottom surface having a non-magnetized surface for attachment to the user's natural nail.

In one embodiment, the at least one nail has a top surface, substantially all of the top surface being clear when the at least one nail is coupled to the nail holding tool.

In one embodiment, the system further comprises a display, the display having a plurality of defined spaces for displaying at least two of said nails, each of said defined spaces being magnetically coupled to one of the said nails.

In one embodiment, each of the defined surfaces is magnetized.

In one embodiment, each of the defined surfaces is defined by a border.

In one embodiment, the each of the defined spaces is labeled with a unique identifier.

In one embodiment, the system further comprises an enclosure for enclosing the display, the enclosure having a removable and transparent front cover.

In one embodiment, the front cover, when attached, seals the display within the enclosure.

In one embodiment, the enclosure further comprises a wall attachment member for attaching the enclosure to a wall.

In one embodiment, the enclosure further comprises a plurality wall spacers for spacing the hung enclosure from the wall.

In one embodiment, the enclosure filter comprises a fold-out back support for inclining the enclosure on a horizontal surface.

In one embodiment, the cover is resistant to ultra-violet rays.

In one embodiment, the enclosure is a box and the cover functions as a lid.

In one embodiment, the display further comprises a wall attachment member for attaching the display to a wall.

In one embodiment, the display further comprises a plurality wall spacers for spacing the hung display from the wall.

In one embodiment, the display further comprises a fold-out back support for inclining the display on a horizontal surface.

In one embodiment, the system further comprises a plurality of nail design elements, and the nail further comprises a top surface, the nail design elements being magnetically coupled to the nail top surface, such that the user can select and arrange the nail design elements into a desired pattern.

In one embodiment, the at least one nail design element is shaped to create at least a partial border about the nail top surface.

In one embodiment, the at least one nail design element is magnetized.

In another embodiment, a system for designing artificial nails for attachment to a user's natural nails is provided, comprising: at least one artificial nail; and means for mounting the nail to a work surface such that the nail is stationary when the work surface is rotated, elevated, inclined or inverted.

In one embodiment, the system further comprises means for displaying a plurality of completed nails.

In one embodiment, the system further comprises means for temporarily attaching design elements to the nail such that the user can select and arrange the nail design elements into a desired pattern.

In one embodiment, the system further comprises means for displaying a plurality of completed nails by magnetically coupling the nail to one of a plurality of defined spaces on a display.

In another embodiment, there is provided a system for designing artificial nails for attachment to a user's natural nails, including a designing method comprising the steps of: magnetically coupling a nail to a nail holding tool; positioning the nail holding tool by manipulating the nail holding tool; and applying design elements to the nail.

In one embodiment, the design elements include paint.

In one embodiment, the design elements are magnetically coupled to the nail.

In one embodiment, the method further comprises the step of a displaying the completed nail by magnetically coupling the nail to one of a plurality of defined spaces on a display.

In one embodiment, the method further comprises the step of enclosing the display such that the display is substantially sealed.

In one embodiment, the method further comprises the step of hanging the display on a wall.

In one embodiment, the method further comprises the step of inclining and supporting the display on a horizontal surface.

In another embodiment, there is provided a system for designing artificial nails for attachment to a user's natural nails, comprising: at least one artificial nail having a top surface; a work surface, the work surface being magnetically coupled to the nail, such that the coupled nail is held steady on the work surface; and a plurality of nail design elements, and the nail further comprises a top surface, the nail design elements being magnetically coupled to the nail top surface, such that the user can select and arrange the nail design elements into a desired pattern.

In one embodiment, the system further comprises a display, the display having a plurality of defined spaces for displaying at least two of said nails, each of said defined spaces being magnetically coupled to one of the said nails.

In one embodiment, each of the defined surfaces is magnetized.

In another embodiment, a system is provided for designing artificial nails for attachment to a user's natural nails, comprising: at least one artificial nail having a top surface; a work surface, the work surface being magnetically coupled to the nail, such that the coupled nail is held steady on the work surface; and means for temporarily coupling one or more design elements to the nail top surface such that the user can select and arrange the nail design elements into a desired pattern.

In one embodiment, the system further comprises means for displaying a plurality of completed nails by magnetically coupling the nail to one of a plurality of defined spaces on a display.

In another embodiment, a system is provided for designing artificial nails for attachment to a user's natural nails, including a designing method comprising the steps of: magnetically coupling a nail to a work surface; positioning the work surface; selecting design elements; and magnetically coupling design elements to the nail.

In one embodiment, the method further comprises the step of permanently attaching additional design elements to a second nail to match the appearance of the magnetically coupled elements on the first nail.

In one embodiment, the method further comprises the step of magnetically coupling the second nail to a second work surface such that the second nail is secure while having design elements permanently attached.

In one embodiment, the permanently attached design elements include paint.

In one embodiment, the method further comprises the step of displaying the completed nail by magnetically coupling the nail to one of a plurality of defined spaces on a display.

In one embodiment, there is provided a system for designing artificial nails for attachment to a user's natural nails, comprising: at least one artificial nail; an elongated nail holding tool, the nail holding tool having a work surface, the work surface being magnetically coupled to the nail, such that the coupled nail is held steady on the work surface, and further such that the work surface can be moved into a desired position by hand-manipulating the holding tool; and a display enclosure, the display enclosure having: a display surface, the display surface having a plurality of defined spaces for displaying at least two of said nails, each of said defined spaces being magnetically coupled to one of the said nails, each of the defined spaces having a border and a unique identification number; a housing encompassing and securing the display surface; a transparent cover attachable to the housing such that the display is sealed within the display enclosure, the cover being resistant to ultra-violet rays; a wall attachment member affixed to the housing for attaching the enclosure to a wall; a plurality of wall spacers affixed to the housing; and a fold-out back support for inclining the enclosure on a horizontal surface.

The foregoing and other objects and advantages will appear from the description to follow. In the description reference is made to the accompanying drawings, which form a part hereof, and in which is shown by way of illustrated specific embodiments in which the invention may be practice. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more filly understood, it will now be described, by way of example, with reference to the accompanying drawing in which:

FIG. 1 is a perspective view of the present invention in use. Shown is the present invention mounted to an upright structure. The invention includes a display case for designer metallic or magnetic nails. The display case is a box-like structure having a frictionally engaging transparent lid for viewing the contents within the box. Adhesively bonded to the interior base of the box is a pliable sheet of metallic or magnetic material whereupon the metallic or magnetic nails are magnetically mounted. On the exterior face of the metallic or magnetic sheet are a plurality of outlines arranged in rows and column with each outline having a unique number assigned thereto whereby each outline can be uniquely identified. Each originally designed metallic or magnetic nail is placed and held magnetically within an outline.

FIG. 2 is a front view of the present invention. Illustrated is the display case of the present invention. The display case has a frictionally fitting transparent cover for protecting the arrangement as well as keeping dust and dirt from contaminating the display. The transparent cover can additionally be made from a transparent material having incorporated therein UV-ray blocking properties.

DESCRIPTION OF THE REFERENCED NUMERALS

Figure 1:
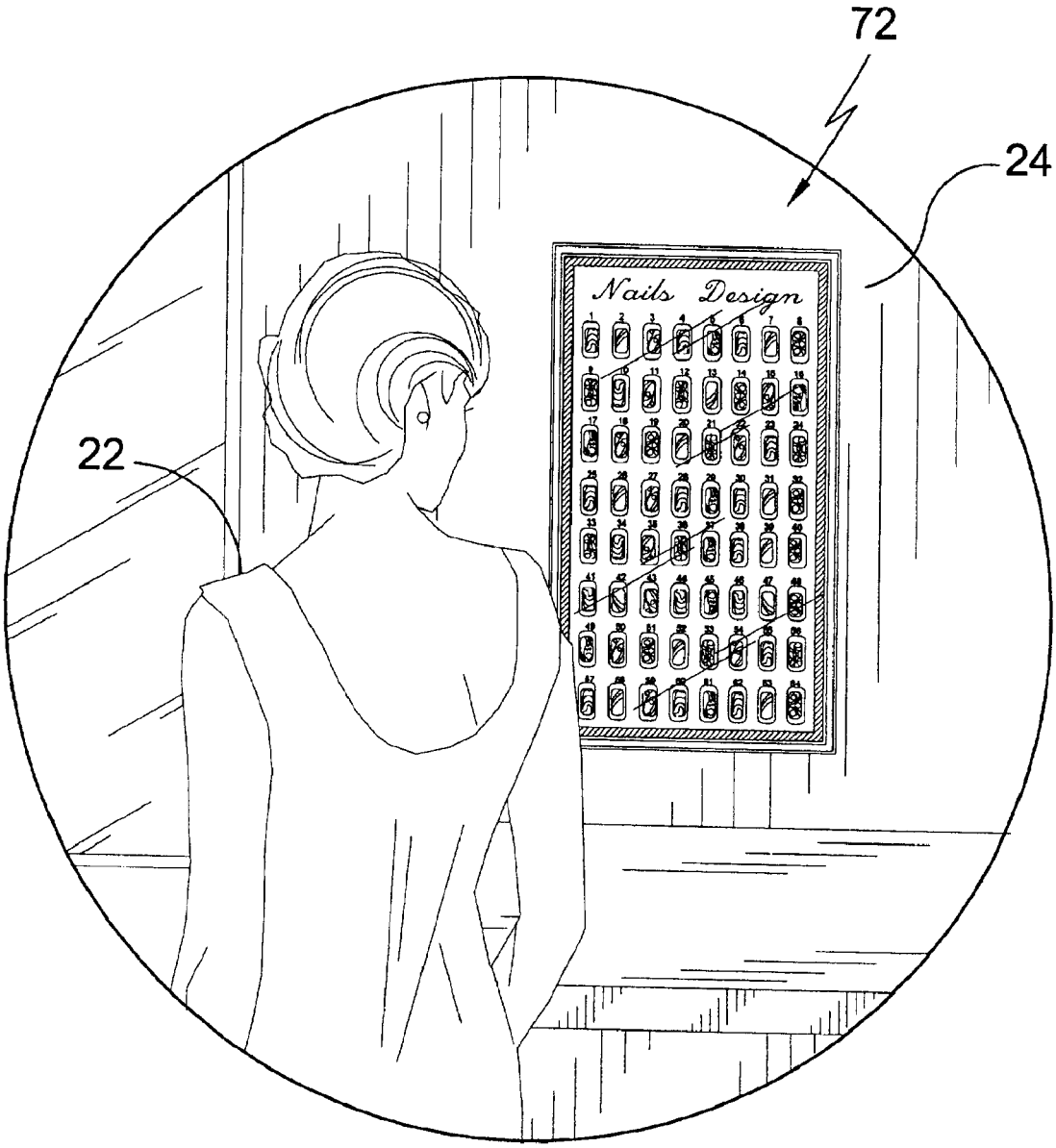
Figure 2:
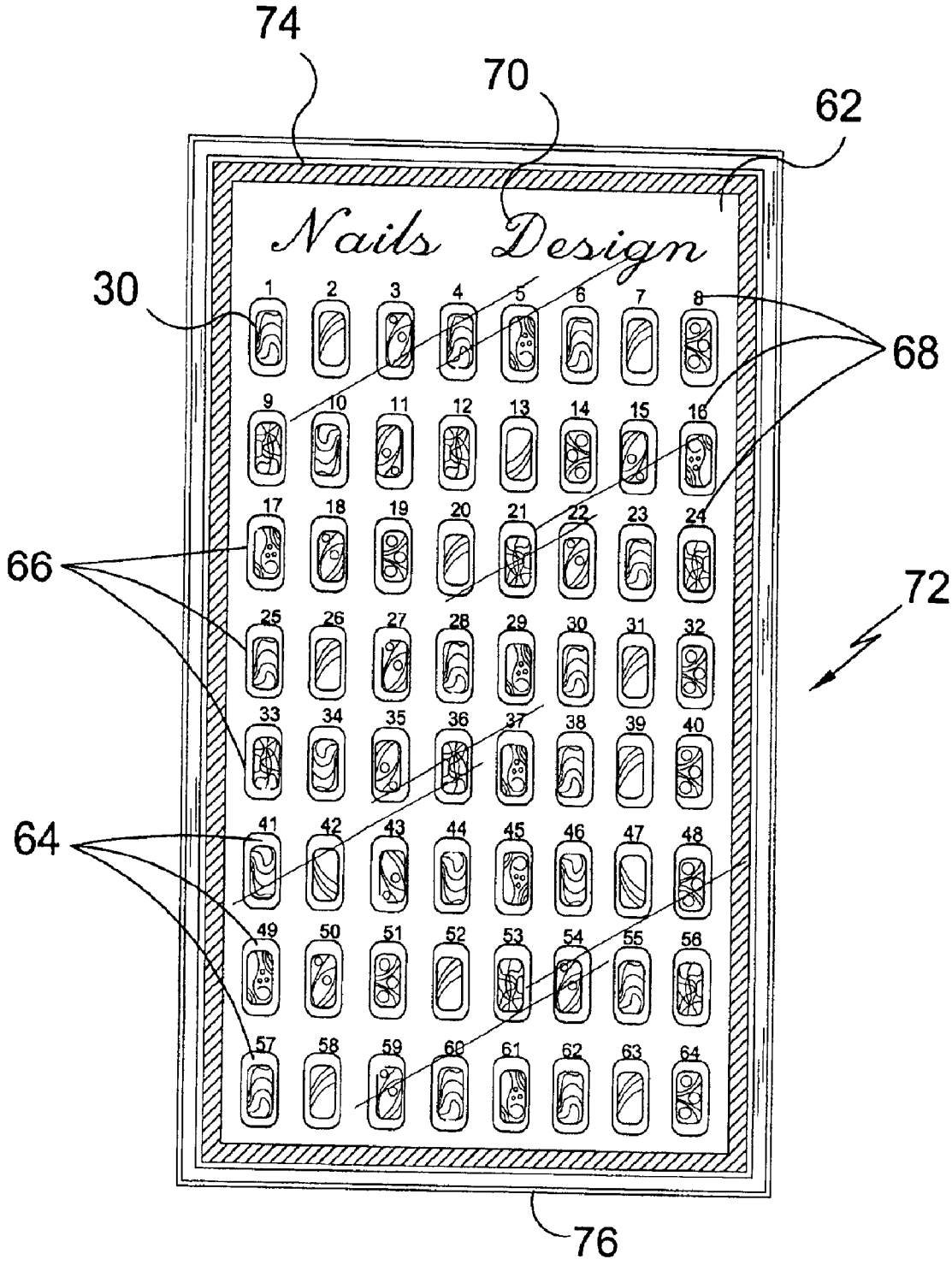

Turning now descriptively to the drawings, in which similar reference characters denote similar elements throughout the several views, the figures illustrate the artificial nail design and display system of the present invention. With regard to the reference numerals used, the following numbering is used throughout the various drawing figures.

20 artificial nail design system of the present invention
22 customer
24 wall
26 horizontal surface
30 nail
32 nail holding tool
34 nail holding tool work surface
36 nail holding tool top surface
38 symbolic magnetic field lines
40 nail holding tool lower portion
42 nail holding tool free end
44 nail top surface
46 nail bottom surface
50 design element—geometric shape
52 design element—exotic shape
54 design element—border
56 design element—geometric shape
60 display board
62 display board front material
64 defined spaces
66 defined space border
68 defined space identification number
70 commercial information—trade name
72 display board enclosure

74 enclosure housing portion

76 enclosure transparent cover

78 enclosure wall attachment member

80 enclosure wall spacers

82 enclosure fold-out back support

DETAILED DESCRIPTION OF THE PREFERRED EMBODIMENT

The following discussion describes in detail various embodiments of the invention. This discussion should not be construed, however, as limiting the invention to those particular embodiments. Practitioners skilled in the art will recognize numerous other embodiments as well. For a definition of the complete scope of the invention, the reader is directed to the appended claims.

FIGS. 1–13 depict various embodiments of the artificial nail design and display system 20 of the present invention. The system 20 is shown being viewed in FIG. 1, by the customer 22.

Figure 9:
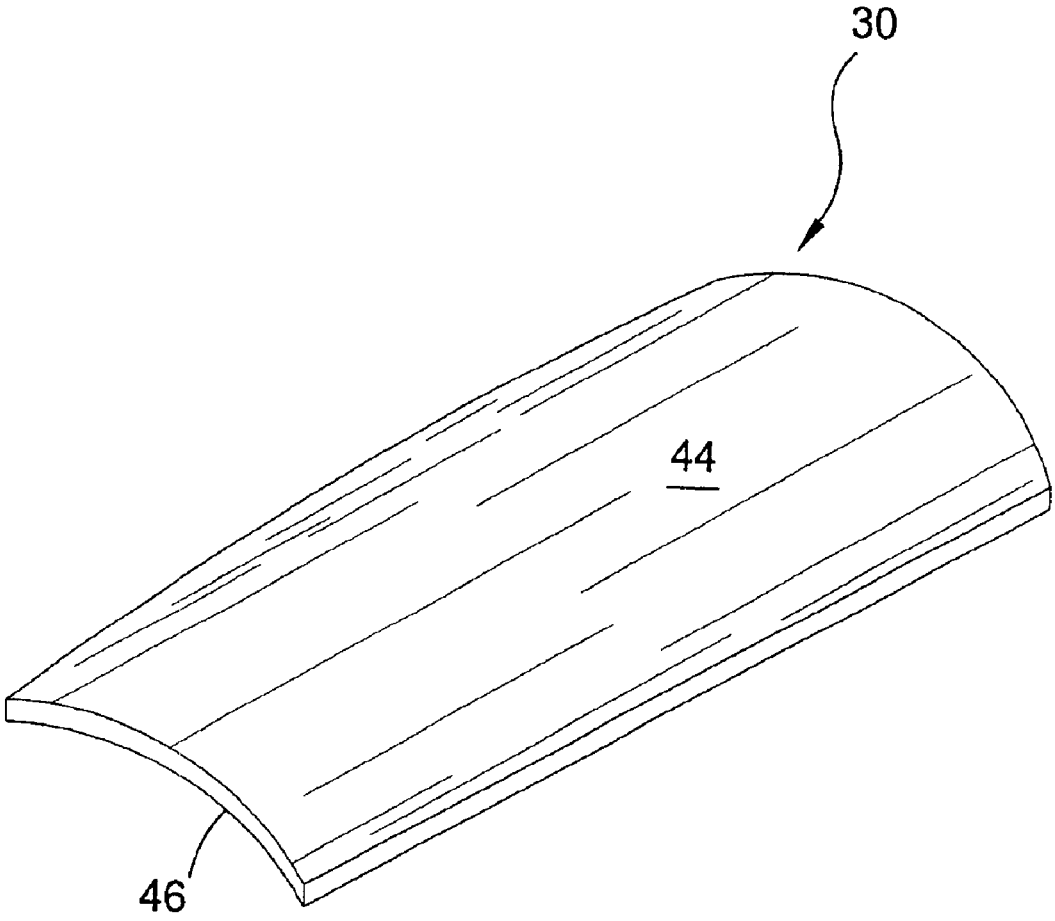
FIG. 9 is a perspective view of the metallic or magnetic nail.
Figure 10:
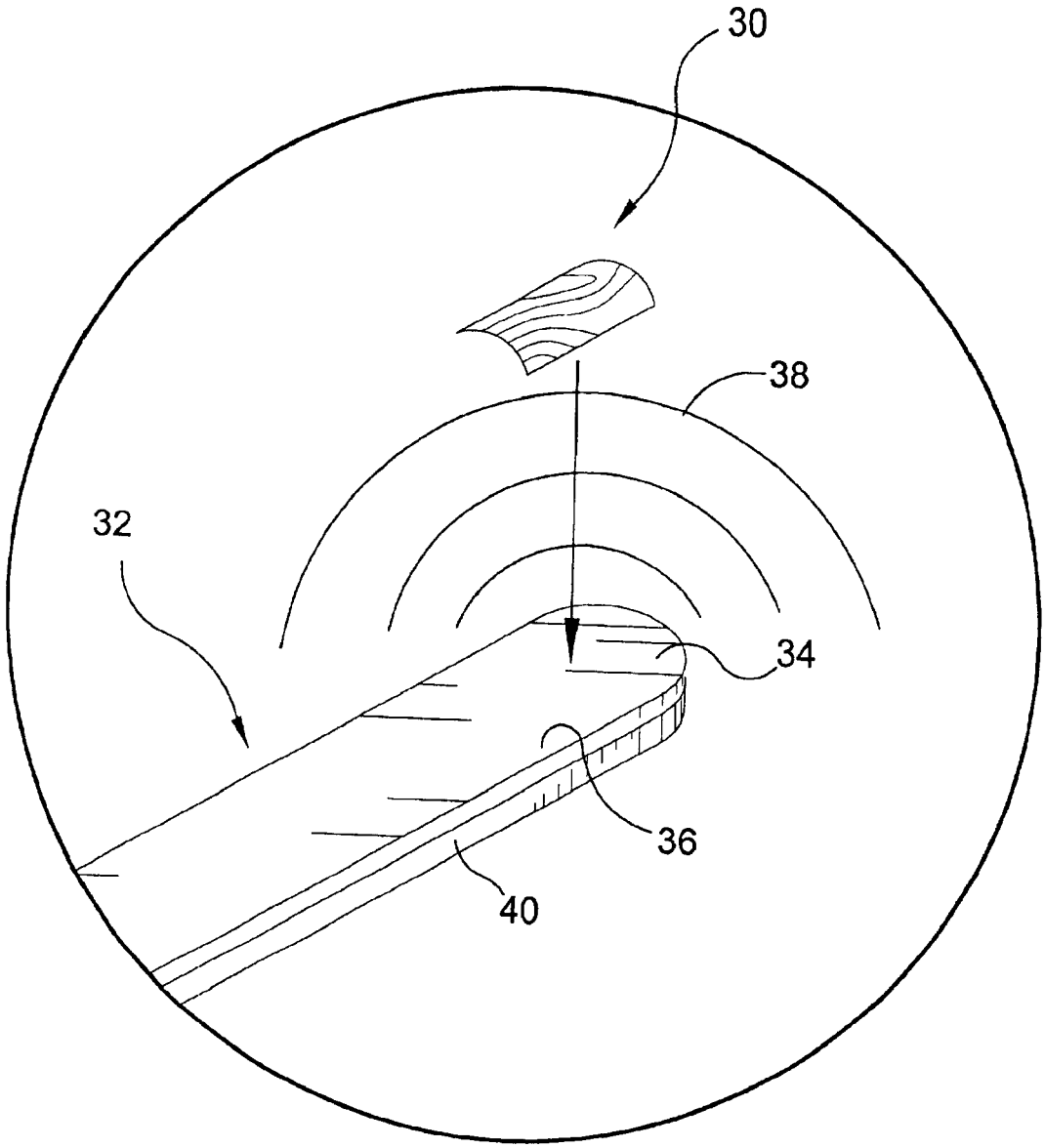
FIG. 10 is a detailed view of the function of the nail holding tool.

In this system, artificial nails 30 of the type commonly attached to a person's natural nail are magnetically coupled to an elongated nail holding tool 32 on a work surface 34 on the tool top surface 36. A typical blank nail 30 and the nail holding tool 32 are shown in FIGS. 9–10. The magnetic material is on the tool 32 in the embodiment shown in FIGS. 10–12. However, either the blank nail 30 or the work surface 34 can be constructed from a magnetized material, while the other will be made of a material attracted by a magnet. My invention encompasses both a magnetized work surface 34 and a magnetized nail 30. Depending on the strength of the magnetized material involved, the blank nail 30 may be constructed of more than one material, including at least one that contributes to the desired magnetic coupling.

Symbolic magnetic field lines 38 are shown in FIG. 10, illustrating the magnetic attraction between the nail 30 and the tool work surface 34.

All or part of the tool top surface 36 can be constructed as the work surface 34, the work surface 34 encompassing that portion of the tool top surface 36 that can be magnetically coupled with the nail 30.

Figure 11:
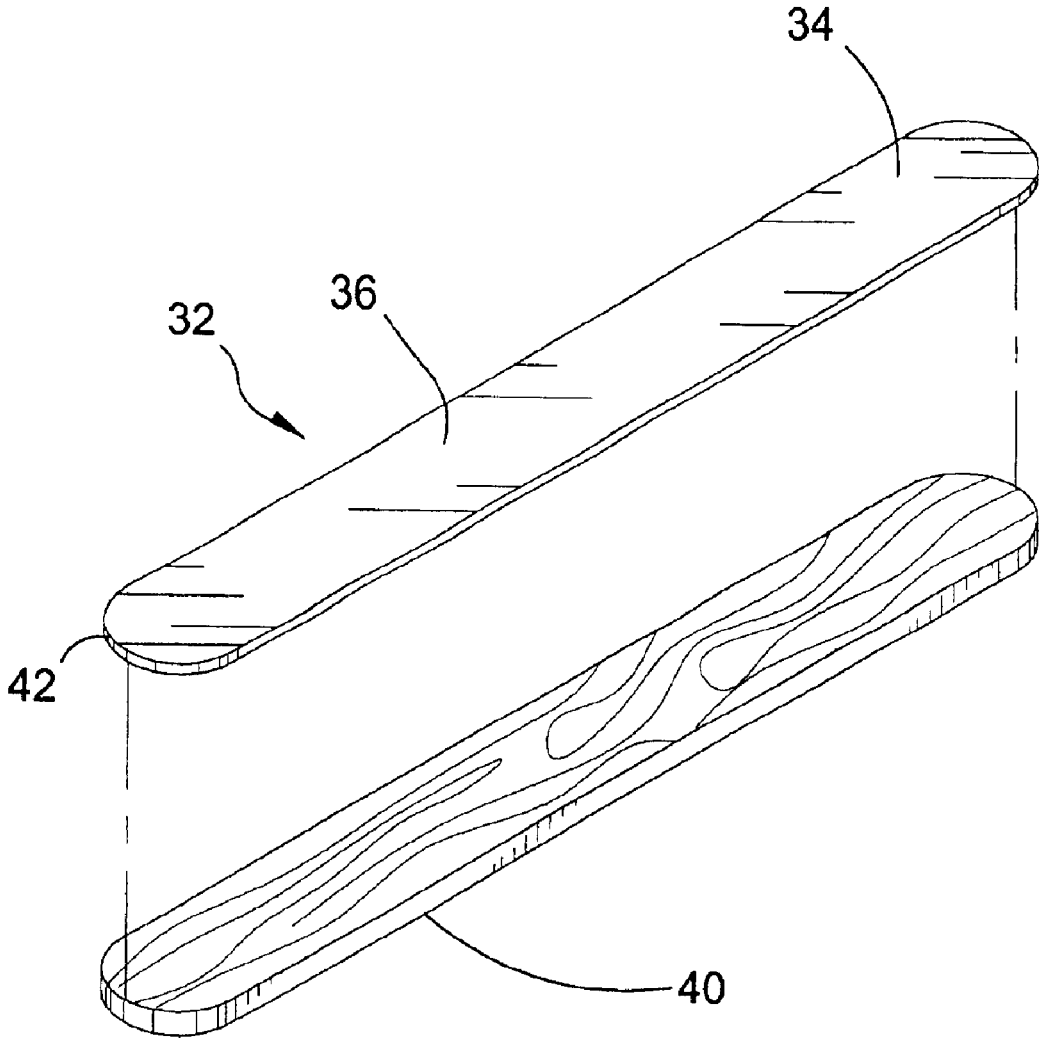
FIG. 11 is an exploded view of the nail holding tool.
Figure 12:
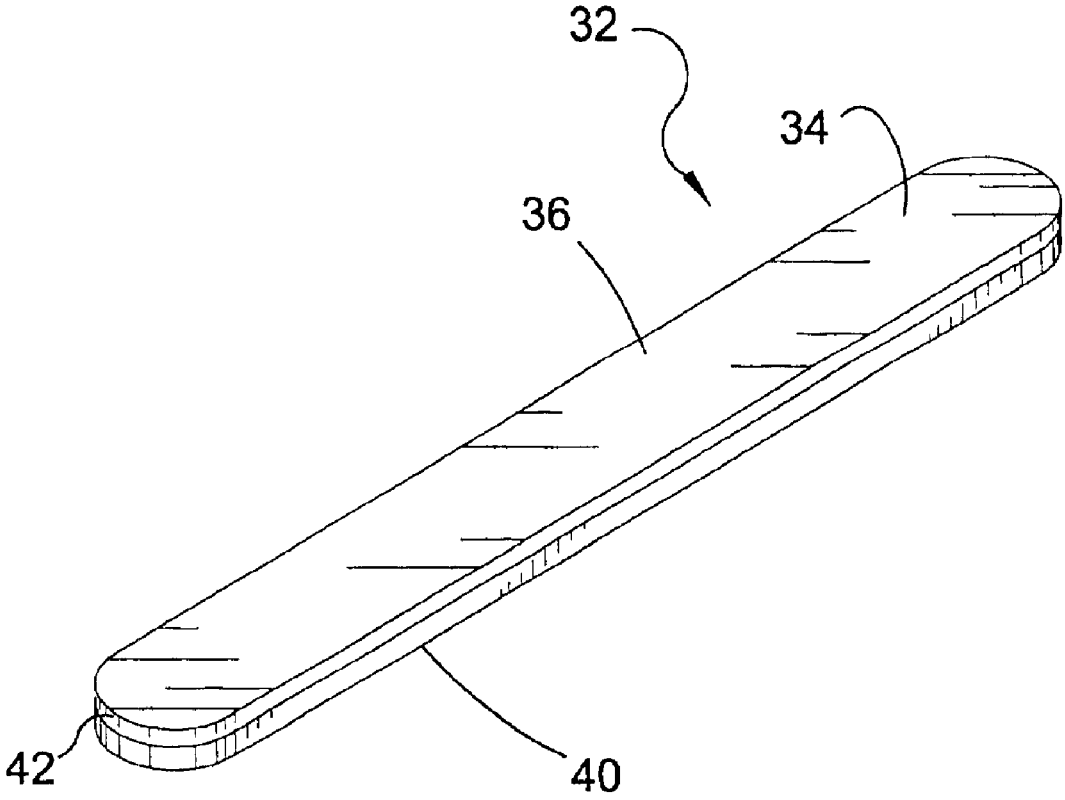
FIG. 12 is a perspective view of the nail holding tool.

Although all of the tool 32 can be made from the same material, the embodiment shown in FIGS. 10–12 has a lower portion 40 constructed from wood. The flattened lower portion 40 creates a stable platform upon which the artisan can place a blank nail 30 to begin the design task. The wood surface 40 prevents undue sliding, although the elongated shape of the tool 32 provides a free end 42 which can be pushed or grasped by the artisan to place the blank nail 30 in the ideal work position.

Because the nail 30 is magnetically coupled to the tool work surface 34, and not inserted or grasped by existing means for securing such a work piece, the nail's 30 entire top surface 44 is accessible by the artisan. The nail bottom surface 46 is elevated above the tool work surface 34 in the embodiment shown in FIGS. 10–12. In another embodiment, the tool top surface 36 is shaped to conform to the nail bottom surface 46.

Figure 13:
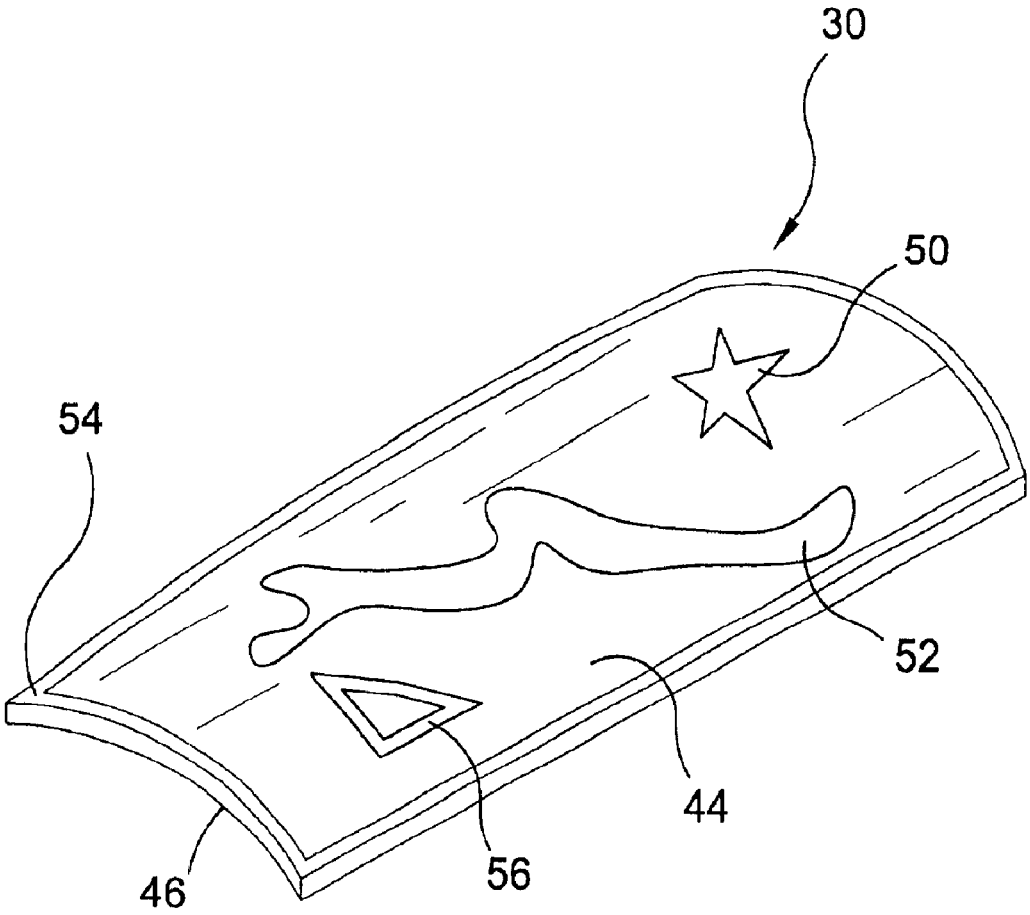
FIG. 13 is a perspective view of an artificial nail with representative design elements magnetically couple the nail top surface.

While held on the tool work area 34, the artisan can paint or otherwise decorate the blank nail 30. As shown in FIG. 13, various design elements 50,52,54,56 can be magnetically coupled to the blank nail 30 to allow various configurations to be evaluated by the artisan or the customer 22. Once the final design is selected, the artisan can use the then existing arrangement of the design elements as a model as the artisan paints, or otherwise permanently details the nail 30 to be purchased.

The design elements 50,52,54,56 can include numerous colors and shapes such as geometric patterns 50,56, exotic shapes 52, and borders 54. As was the case with the materials chosen for the nail 30 and the tool work surface 34, either the design elements 50,52,54,56 can be made from a magnetized material, or the nail 30 can be made from a magnetized material. In the embodiment shown in FIGS. 9–13, the nail 30 is made from a material attracted to a magnet, while the design elements 50,52,54,56 are made from a magnetized material.

Figure 3:
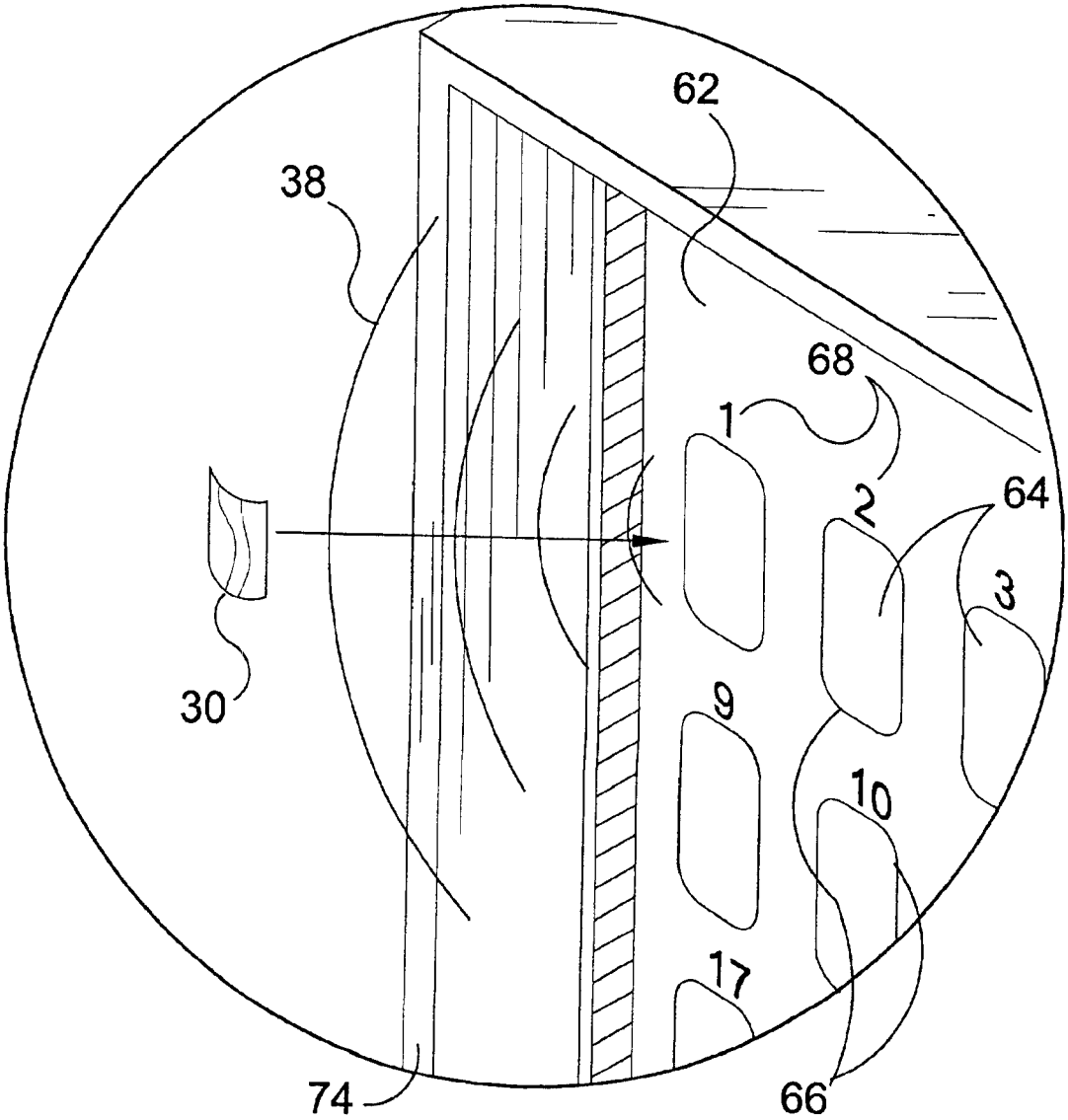
FIG. 3 is a perspective view of the functioning of the metallic or magnetic sheet. Shown is a portion of the display case with the transparent lid removed with an originally designed metallic or magnetic nail ready to be magnetically coupled to one of the uniquely numbered outlines.
Figure 4:
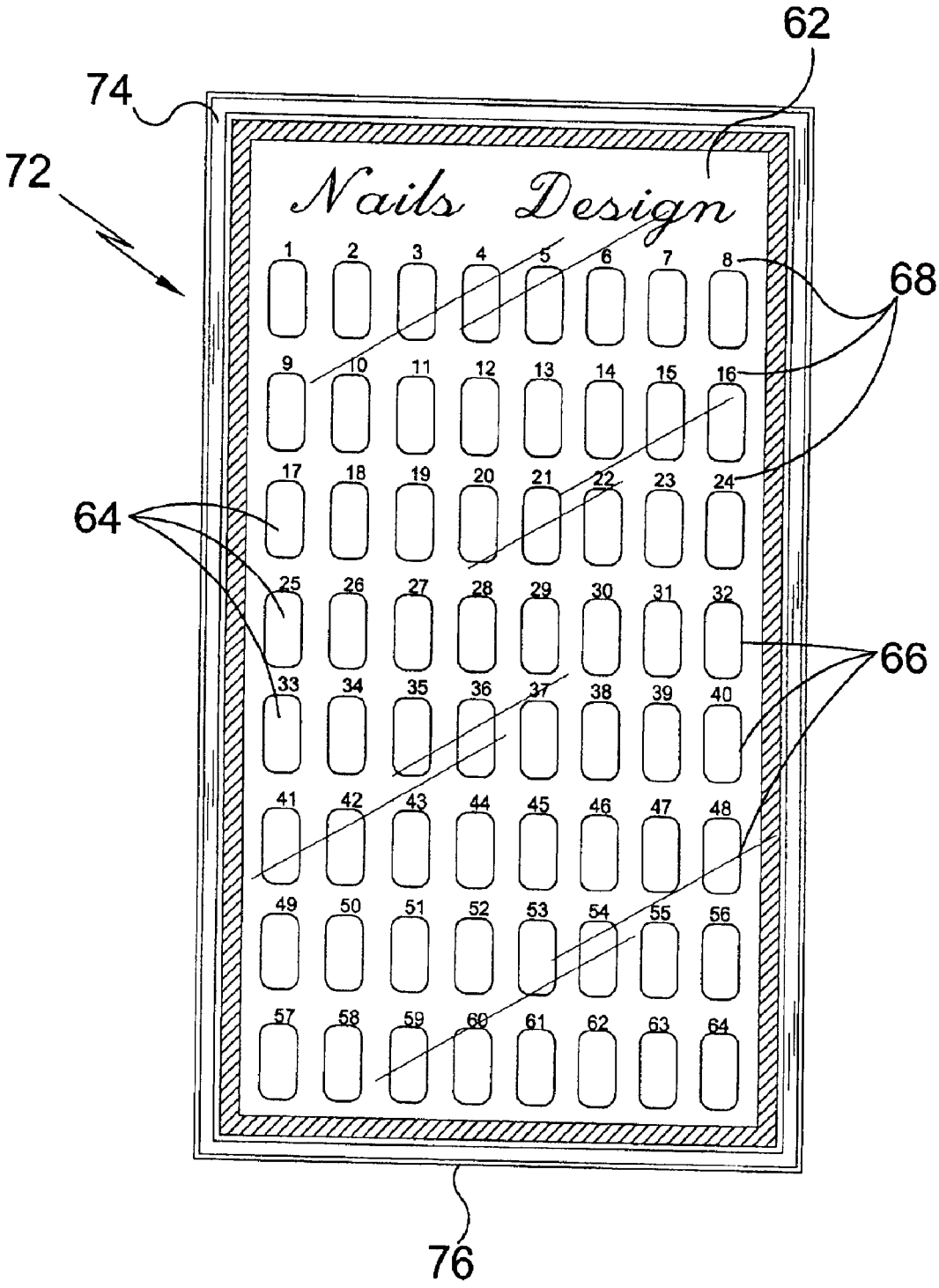
FIG. 4 is a front view of the present invention. Illustrated is the display case of the present invention having a plurality of outlines awaiting the magnetic attachment of one or more nails.
Figure 5:
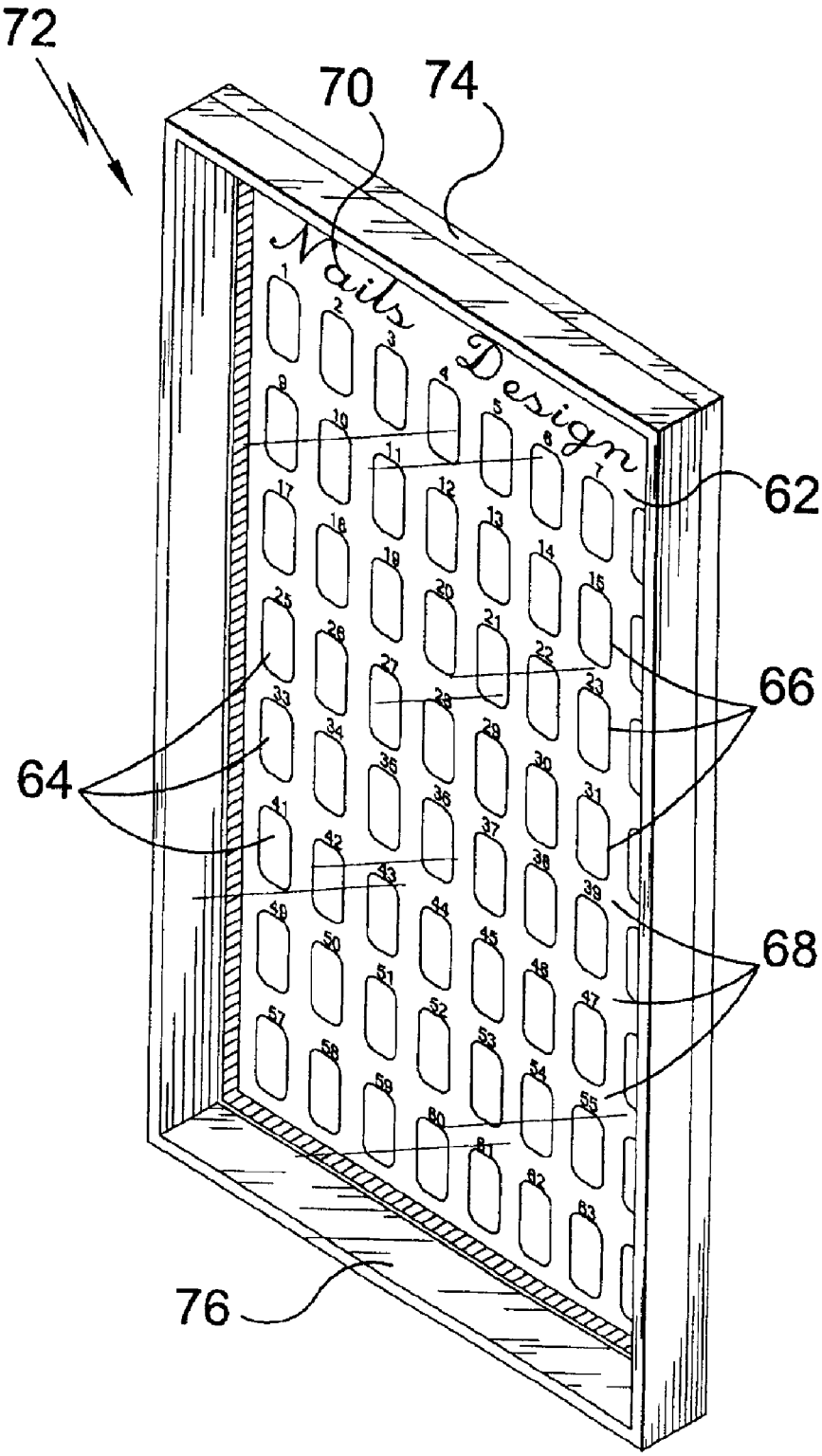
FIG. 5 is a perspective view of the present invention. Shown is a perspective view of the display case.

The magnetic coupling innovations of my design system 20 also enhance the storage and display of completed nails 20. As shown in FIGS. 1–6, a display board 60 has a front material 62 that has defined spaces 64. The defined spaces 64 can be magnetically coupled with completed nails 20. FIG. 3 illustrates the symbolic magnetic field lines 38 involved in the magnetic coupling of the nail 30 with one of the defined spaces 64. The spaces 64 are delineated by borders 66 and identified with unique numbers 68. The unique numbers 68 assist the artisan in the merchandising of the completed nails 30.

The display board includes space for basic commercial information such as the artisans trade name 70.

The display board front material 62 will be made from either a magnetized material or a material attracted by magnets, the choice being the same as the tool work surface 34. When the material is so selected, the nail 30 can be magnetically coupled to both the tool work surface 34 and the display board front material 62 in the defined space 64.

The magnetic coupling of the completed nails 30 in the defined spaces 64 creates the optimum display, in that all of the nail top surface 44 is visible by the customer 22. In typical display boards the nails would be grasped by other structures or recessed, thus hiding part of the now fully designed nail top surface 44. In other embodiments, the defined spaces 64 can themselves be spaced in an attractive pattern to complement the appearance of the completed items.

The display board 60 can be protected from unwanted contact, dust and dirt by inserting the board 60 into a display enclosure 72 such as the box-shaped housing 74 shown in FIGS. 1–6. The enclosure 72 is completed by attaching a transparent cover 76 to the box 74, in this case by the squeeze fit provided by the close sizing of the housing 74 and cover 76. In this embodiment, the cover 76 resists ultraviolet rays for the protection of the contents.

Figure 6:
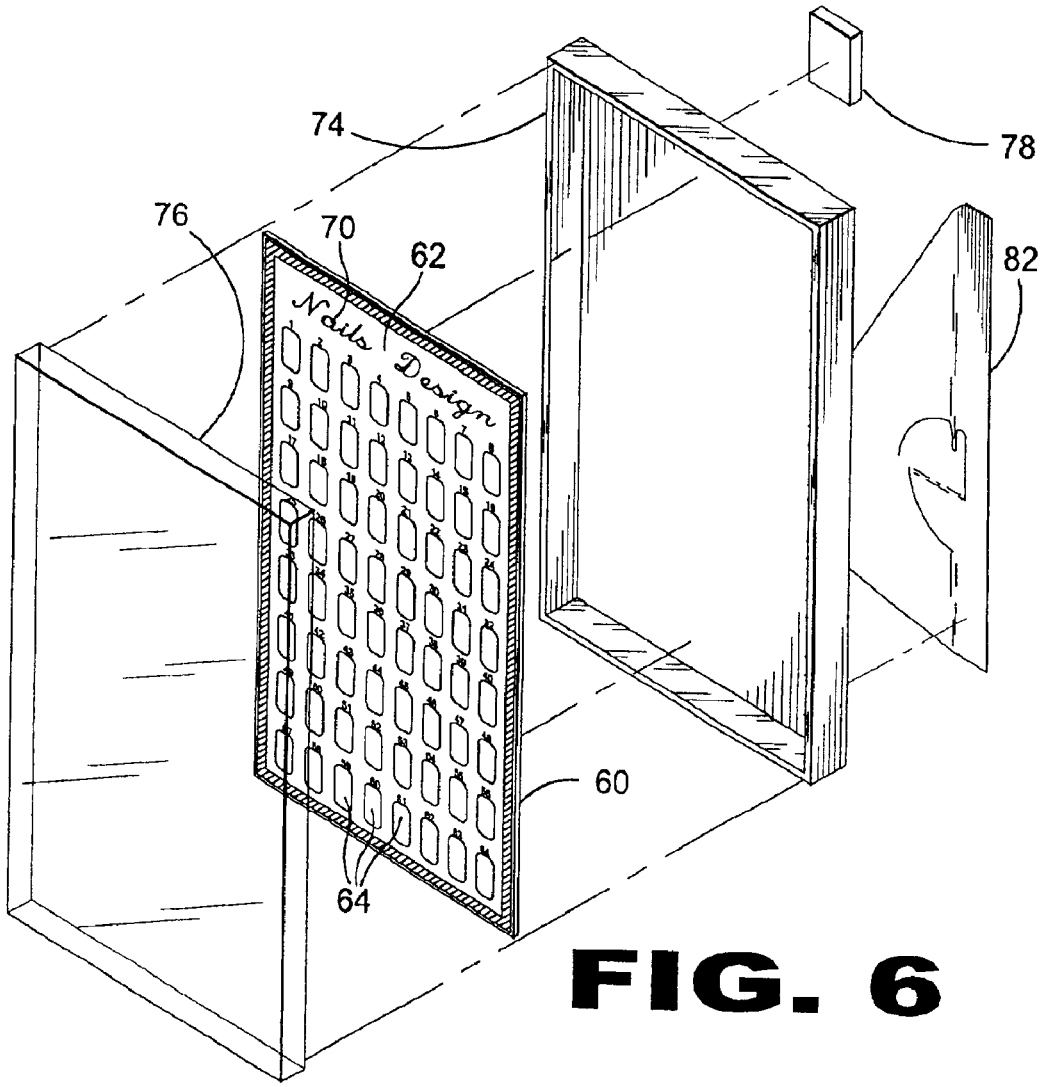
FIG. 6 is an exploded view of the present invention. Displayed is the present invention exploded into its component parts.
Figure 7:
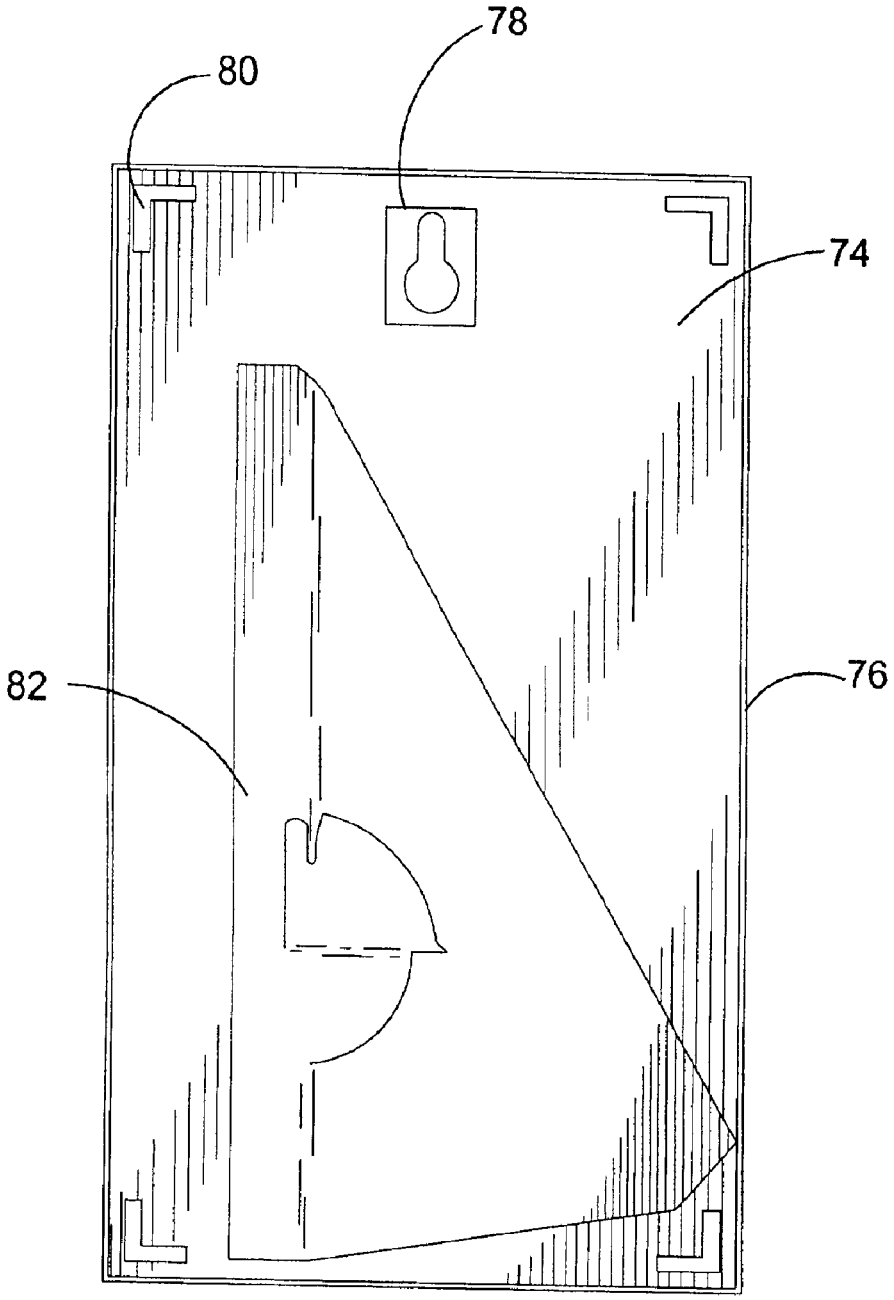
FIG. 7 is a back view of the present invention. Shown is the backside of the display case attachments providing attachment to an upright structure or displaying it in a freestanding manner on a horizontal surface.
Figure 8:
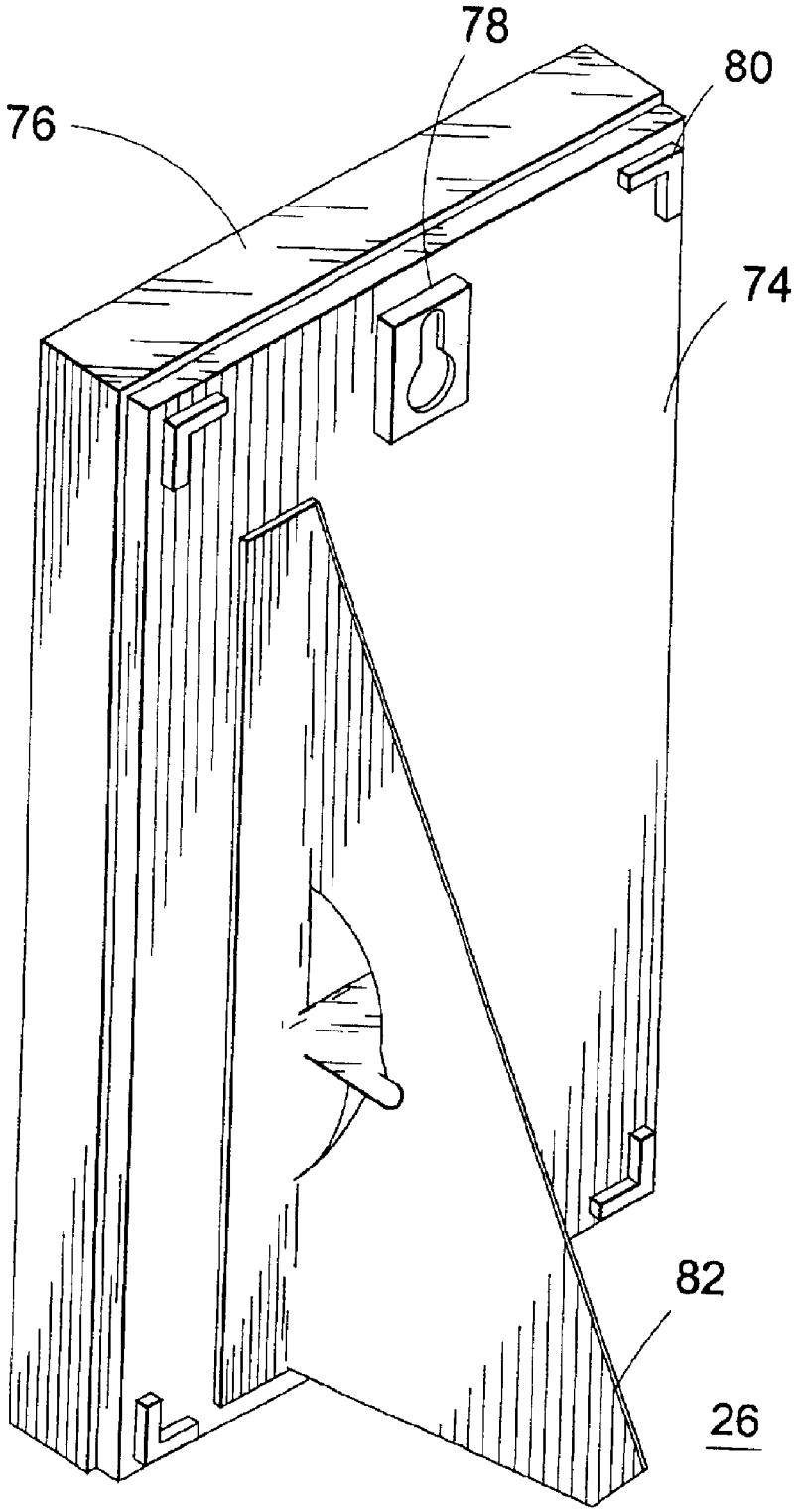
FIG. 8 is a back perspective view of the present invention. Illustrated is the display case in a freestanding position.

Affixed to the housing 74 is a wall attachment member 78, as shown in FIGS. 6–8. The wall attachment member 78 provides a means for hanging the assembled display enclosure 72 on a wall 24 for customer 22 observation, as shown in FIG. 1. Wall spacers 80 are also affixed to the housing 72 to enable a flush and stable position with respect to the wall 24, as shown in FIGS. 7–8. The wall attachment member 78 is comprised of a fixedly positioned element having an aperture therein whereby the display case and integral fastener attachment can be hung from a fastener on an upright structure.

FIGS. 6–8 also depict the means for inclining the display enclosure 72 on a horizontal surface 26 are provided in the form of a fold-out back support 82. When folded rearward to form a perpendicular footing, the back support 82 inclines and supports the enclosure 72. Even at the steep incline shown in FIG. 8, the magnetic coupling between the nails 30 and the defined spaces 64 ensures the full and attractively organized display of the completed nails 30.

From the discussion above, it is shown that the artisan begins the design of a nail 30 by first positioning a blank nail 30 on the tool work surface 34 of the nail holding tool 32, the positioning being secured by the magnetic coupling of the nail 30 to the tool work surface 34. The customer 22 will be present for a customized design utilizing the customer's 22 input. By repeatedly positioning a variety of design elements 50,52,54,56 in various configurations on the nail 30, the customer 22 and/or the artisan can pick the most suitable and aesthetically pleasing design. The nail holding tool 32 assists in the process by allowing the nail 30 to be securely moved between the artisan and the customer 22, and to be rotated, elevated and/or inclined as needed to present the necessary views for the participants.

For the customer 22 who wants to be able to continually change the nail 30 design, the artisan can sell blank nails 30 and a variety of the design elements 50,52,54 for the customer's 22 design experimentation at home. The customer 22 can also acquire the nail holding tool 32 in order to continue the enhanced nail 30 positioning during the ongoing design process.

For the customer 22 who wants a completed set of nails 30, or the artisan who wants to establish an inventory of completed nails 30, the artisan will use the chosen design as a model for the permanent painting and/or other decorating on blank nails 30. One or more additional nail holding tools 32 can be utilized, one tool 32 for the model nail 30 and one for each of the nails 30 onto which the model nail 30 design is being copied.

Once the design has been affixed to the blank nail 30, the artisan can choose to retain some completed nails 30 as representative display models or for general inventory. Rather than conceal part of the design by pushing the nails 30 into recesses or hooks, the artisan magnetically couples each completed nail 30 within the border 66 of a defined space 64 on the front material 62 of the display board 60. The display board 60 with its attached nails 30 is then inserted into the housing 74 portion of the display board enclosure 72, and sealed by attaching the transparent cover 76 to the housing 74. The enclosure 72 is then displayed by either hanging the enclosure 72 on a wall 24 using the wall attachment member 78, or inclining the enclosure 72 on a horizontal counter surface 26 using the fold out back support 80. Individual nails 30 can be removed from the enclosure 72 and again magnetically coupled with the nail holding tool work surface 34 for a secure and almost hand-free display of the individual nails 30 to inquiring customers 22.

With respect to the above description then, it is to be realized that the optimum material and dimensional relationships for the parts of the artificial nail design and display system, will include variations in size, materials, shape, and form, which will occur to those skilled in the art upon review of the present disclosure. For example the enclosure housing 74 can be constructed from various woods, metals, glasses and plastics, and the cover 76 can be constructed from various transparent glasses, sheet materials, and plastics. The magnetic features of the nail 30, the nail holding tool work surface 34, and the design elements 50,52,54 can be reversed. A large number of variously shaped and colored design elements can also be included. All equivalent relationships to those illustrated in the drawings and described in the specification are intended to be encompassed by the present invention.

What is claimed as new and desired to be protected by Letters Patent is set forth in the appended claims:

1. A system for designing artificial nails for attachment to a user's natural nails, comprising:

at least one artificial nail; and an elongated nail holding tool, the nail holding tool having a work surface, the work surface being magnetically coupled to the nail, such that the coupled nail is held steady on the work surface, and further such that the work surface can be moved into a desired position by hand-manipulating the holding tool.

2. The system of claim 1, wherein the nail is magnetized.

3. The system of claim 1, wherein the nail holding tool top surface is magnetized.

4. The system of claim 1, wherein the nail holding tool has a non-metallic bottom surface.

5. The system of claim 1, wherein the nail holding tool has a non-slip bottom surface.

6. The system of claim 1, wherein the nail holding tool has a substantially flat bottom surface.

7. The system of claim 1, wherein the nail holding tool has a wooden bottom surface.

8. The system of claim 1, wherein the nail holding tool has a handle.

9. The system of claim 1, wherein the nail is made of at least two materials, and one of the materials cannot be magnetically coupled.

10. The system of claim 1, wherein the nail further comprises a curved bottom surface, and the nail holding tool work surface is at least partially curved for mating with the nail curved bottom surface.

11. The system of claim 1, wherein the at least one nail has a bottom surface, the bottom surface having a non-magnetized surface for attachment to the user's natural nail.

12. The system of claim 1, wherein the at least one nail has a top surface, substantially all of the top surface being clear when the at least one nail is coupled to the nail holding tool.

13. The system of claim 1, wherein the system further comprises a display, the display having a plurality of defined spaces for displaying at least two of said nails, each of said defined spaces being magnetically coupled to one of the said nails.

14. The system of claim 13, wherein each of the defined surfaces is magnetized.

15. The system of claim 13, wherein each of the defined surfaces is defined by a border.

16. The method of claim 13, wherein the each of the defined spaces is labeled with a unique identifier.

17. The system of claim 13, wherein the system further comprises an enclosure for enclosing the display, the enclosure having a removable and transparent front cover.

18. The system of claim 17, wherein the front cover, when attached, seals the display within the enclosure.

19. The system of claim 17, wherein the enclosure further comprises a wall attachment member for attaching the enclosure to a wall.

20. The system of claim 19, wherein the enclosure further comprises a plurality wall spacers for spacing the hung enclosure from the wall.

21. The system of claim 17, wherein the enclosure further comprises a fold-out back support for inclining the enclosure on a horizontal surface.

22. The system of claim 17, wherein the cover is resistant to ultra-violet rays.

23. The system of claim 17, wherein the enclosure is a box and the cover functions as a lid.

24. The system of claim 13, wherein the display further comprises a wall attachment member for attaching the display to a wall.

25. The system of claim 18, wherein the display further comprises a plurality wall spacers for spacing the hung display from the wall.

26. The system of claim 13, wherein the display further comprises a fold-out back support for inclining the display on a horizontal surface.

27. The system of claim 1, wherein the system further comprises a plurality of nail design elements, and the nail further comprises a top surface, the nail design elements being magnetically coupled to the nail top surface, such that the user can select and arrange the nail design elements into a desired pattern.

28. The system of claim 27, wherein the at least one nail design element is shaped to create at least a partial border about the nail top surface.

29. The system of claim 27, wherein the at least one nail design element is magnetized.

30. In a system for designing artificial nails for attachment to a user's natural nails, a designing method comprising the steps of:

magnetically coupling a nail to a nail holding tool;

positioning the nail holding tool by manipulating the nail holding tool; and applying design elements to the nail.

31. The method of claim 30, wherein the design elements include paint.

32. The method of claim 30, wherein the design elements are magnetically coupled to the nail.

33. The method of claim 30, wherein the method further comprises the step of displaying the completed nail by magnetically coupling the nail to one of a plurality of defined spaces on a display.

34. The method of claim 33, wherein the method further comprises the step of enclosing the display such that the display is substantially sealed.

35. The method of claim 33, wherein the method further comprises the step of hanging the display on a wall.

36. The method of claim 33, wherein the method further comprises the step of inclining and supporting the display on a horizontal surface.

37. A system for designing artificial nails for attachment to a user's natural nails, comprising:

at least one artificial nail having a top surface;

a work surface, the work surface being magnetically coupled to the nail, such that the coupled nail is held steady on the work surface; and a plurality of nail design elements, and the nail further comprises a top surface, the nail design elements being magnetically coupled to the nail top surface, such that the user can select and arrange the nail design elements into a desired pattern.

38. The system of claim 37, wherein the system further comprises a display, the display having a plurality of defined spaces for displaying at least two of said nails, each of said defined spaces being magnetically coupled to one of the said nails.

39. The system of claim 38, wherein each of the defined surfaces is magnetized.

40. A system for designing artificial nails for attachment to a user's natural nails, comprising:

at least one artificial nail having a top surface;

a work surface, the work surface being magnetically coupled to the nail, such that the coupled nail is held steady on the work surface; and means for temporarily coupling one or more design elements to the nail top surface such that the user can select and arrange the nail design elements into a desired pattern.

41. The method of claim 40 wherein the system further comprises means for displaying a plurality of completed nails by magnetically coupling the nail to one of a plurality of defined spaces on a display.

42. In a system for designing artificial nails for attachment to a user's natural nails, a designing method comprising the steps of:

magnetically coupling a nail to a work surface;

positioning the work surface;

selecting design elements; and magnetically coupling design elements to the nail.

43. The method of claim 42, further comprising the step of permanently attaching additional design elements to a second nail to match the appearance of the magnetically coupled elements on the first nail.

44. The method of claim 43, further comprising the step magnetically coupling the second nail to a second work surface such that the second nail is secure while having a design elements permanently attached.

45. The method of claim 43, wherein the permanently attached design elements include paint.

46. The method of claim 43, wherein the method further comprises the step of displaying the completed nail by magnetically coupling the nail to one of a plurality of defined spaces on a display.

47. A system for designing artificial nails for attachment to a user's natural nails, comprising:

at least one artificial nail;

an elongated nail holding tool, the nail holding tool having a work surface, the work surface being magnetically coupled to the nail, such that the coupled nail is held steady on the work surface, and further such that the work surface can be moved into a desired position by hand-manipulating the holding tool; and a display enclosure, the display enclosure having:

a display surface, the display surface having a plurality of defined spaces for displaying at least two of said nails, each of said defined spaces being magnetically coupled to one of the said nails, each of the defined spaces having a border and a unique identification number;

a housing encompassing and securing the display surface;

a transparent cover attachable to the housing such that the display is sealed within the display enclosure, the cover being resistant to ultra-violet rays;

a wall attachment member affixed to the housing for attaching the enclosure to a wall;

a plurality of wall spacers affixed to the housing; and a fold-out back support for inclining the enclosure on a horizontal surface.

* * * * *